United States Patent [19]

Spanel et al.

[11] 4,059,021

[45] Nov. 22, 1977

[54] APPARATUS FOR CONVERTING OSCILLATORY MOTION TO RECIPROCATING MOTION

[75] Inventors: Abram N. Spanel, Princeton, N.J.; P. Frank Eiland, Stamford; David R. Jacobs, New Canaan, both of Conn.

[73] Assignee: Abram N. Spanel, Princeton, N.J.

[21] Appl. No.: 699,905

[22] Filed: June 25, 1976

[51] Int. Cl.[2] ..... F16H 27/02; F16H 21/16; D05C 15/00

[52] U.S. Cl. ..... 74/89.2; 74/25; 74/88; 74/108; 74/136; 112/79 R; 112/221; 192/41 S

[58] Field of Search ..... 74/89.2, 136, 137, 138, 74/108, 217 B, 25, 88, 87, 89 R, 89.22, 89.19; 192/41 S, 26; 112/79 R, 79 FF, 221; 139/127

[56] References Cited

U.S. PATENT DOCUMENTS

| | | | |
|---|---|---|---|
| 1,998,136 | 4/1935 | Jaenichen et al. | 74/89.2 |
| 2,522,582 | 9/1950 | Newman | 112/221 |
| 2,706,913 | 4/1955 | Trossi | 74/89.2 |
| 2,734,606 | 2/1956 | Bellamy | 192/26 |
| 3,232,399 | 2/1966 | Hamed et al. | 192/26 |
| 3,439,638 | 4/1969 | Zuk | 112/219 |
| 3,521,499 | 7/1970 | Keith | 74/89.2 |
| 3,554,147 | 1/1971 | Spanel | 112/79 R |
| 3,614,898 | 10/1971 | Paine | 74/89.2 |
| 3,678,968 | 7/1972 | Juillard | 139/127 R |

*Primary Examiner*—Samuel Scott
*Assistant Examiner*—Randall Heald
*Attorney, Agent, or Firm*—J. Rodman Steele, Jr.

[57] ABSTRACT

Apparatus for converting oscillatory motion to reciprocating motion featuring the use of thin, non-permanently deformable band-like members confined to a linear track so as to be reciprocable when one end of the band-like member is engaged by an oscillatory shaft. The other end of the band-like member may be secured to a work element used for exerting force against a work object. Selection means may be employed in apparatus having a plurality of band-like members in which each of the members can be selectively induced into engagement with a shaft or other oscillatory means to control the work elements as desired.

17 Claims, 12 Drawing Figures

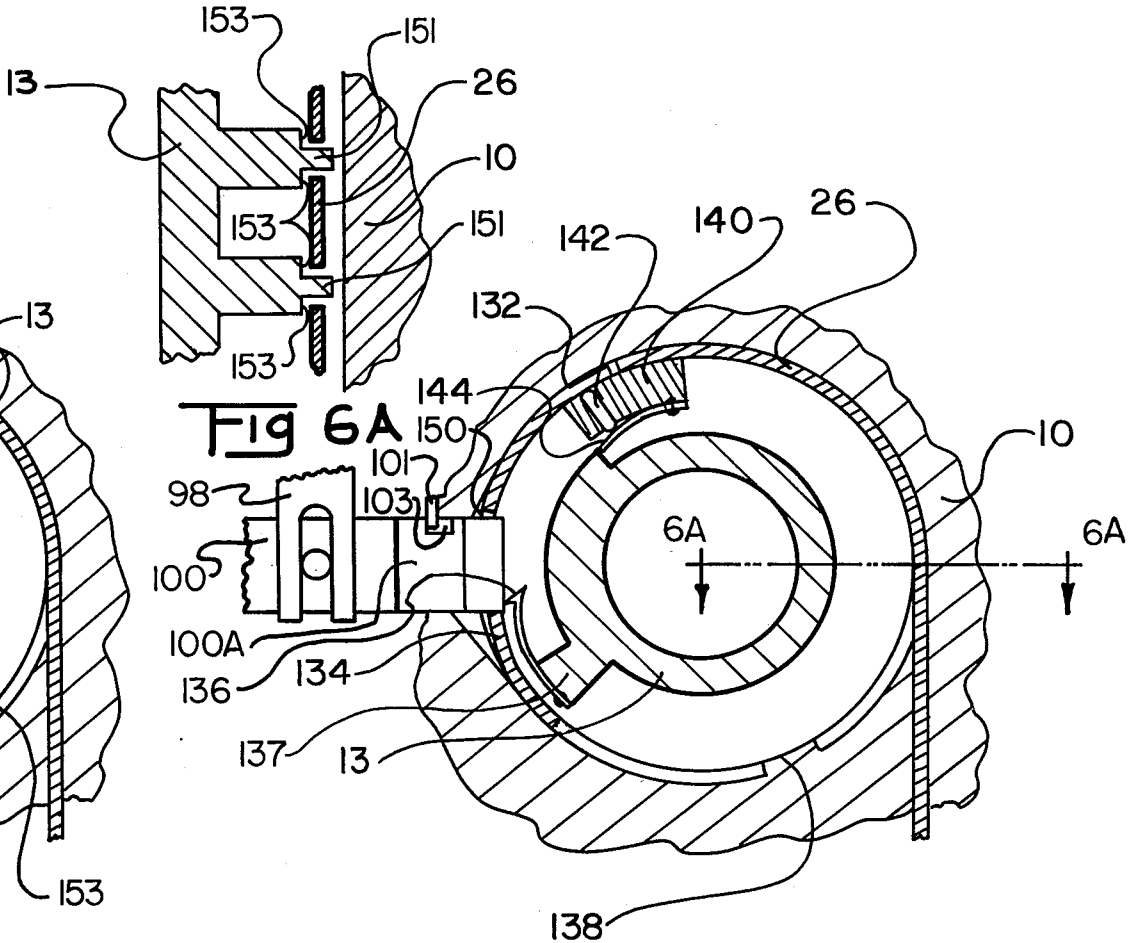
Fig 6
Fig 6A
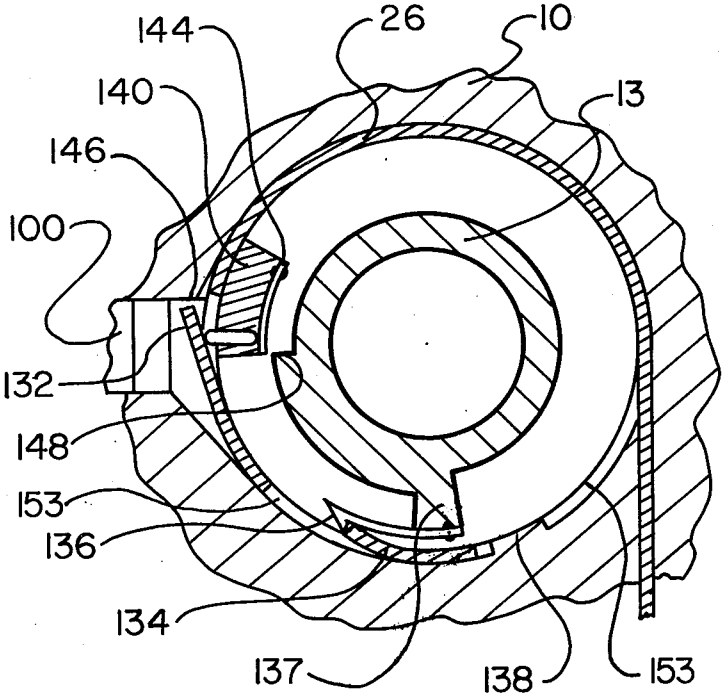
Fig 5

APPARATUS FOR CONVERTING OSCILLATORY MOTION TO RECIPROCATING MOTION

BACKGROUND OF THE INVENTION

The subject application discloses a means to drive a work element against a work object and additionally provides the capability of selectively engaging individual work elements from a plurality of available elements so that complex operations necessitating precise movement and timing functions may be carried out. The subject invention has utility in many fields with textile manufacturing processes being one of these fields. For example, yarn can be accurately metered and fed from the yarn source to a process station by utilizing the teachings of the subject invention with the work elements serving as plungers which positively engage the yarn and displace it as desired for the feeding and metering operation.

Additionally, the work element or driven member may be a yarn implanting needle, a severing means or any of a variety of driven members utilized in textile operations. It is to be noted that textile use is but one example and fields of use are actually quite limitless in view of the physical characteristics of the driving member, i.e., the band-like member. In particular, the lightweight of the band-like member and small area necessary for its containment make it adaptable to many complex systems.

For a more precise understanding of some of the uses of the subject invention, reference is hereby made to copending Application Ser. Nos. 699,904, 700,413 and 699,906.

In many types of machinery, tremendous forces are necessary to drive work elements such as for example, needles of a tufting machine. Conventionally, needles, in excess of a thousand in some systems, are driven by driving means usually comprising cam or eccentric shaft driven elements which are massive in size and weight. It becomes prohibitive to develop driving forces for individual needle units by conventional means since linkage and the driving means in general cannot be confined to a small enough space to make such machines feasible. However, many advantages are present when individual needle selection is enabled as for example, needles may be positioned in series formation so that different needles within each series are supplied with different colored yarns. Thus, for patterning or reproducing designs in colored yarns, one of the series of needles may be selected at a time to tuft a desired color. To develop such a system, however, the selection and driving means must be relatively small and lightweight so as to be confinable to a restrictive area. Conventional equipment, with its mass, is unsuitable.

SUMMARY OF THE INVENTION

Accordingly, the subject invention provides a driving system whereby oscillatory motion can be selectively converted to reciprocating motion as enabled by the selection of individual intermediate members which serve as driving members for driven work elements.

Each of the intermediate driving members comprises a thin flexible (when unrestrained) but not permanently deformable, band-like ribbon member, preferably constructed of steel. Each of these band-like members is engageable by an oscillatory shaft. The band-like member extends tangentially from the shaft and must be restrained in track-like structure so that once leaving the shaft, the path of the band is kept straight. At an end removed from said shaft, the band is secured to a work element which becomes reciprocable upon operation of the apparatus and will carry out any number of desired functions. While the work element may be used to impact against a work object, uses are not necessary limited to this type of function since the work element may be a knife or other element used for severing a work piece.

The band-like member is driven or guided into engagement with a shaft or oscillatory member and accordingly, the band terminates at its one end in a latching means which is to be driven into engagement with the oscillatory member by solenoid means. A small electric solenoid is sufficient since very little force is necessary for the selection process, i.e., causing the band-like member to latch with receiving structure of the oscillatory shaft.

Control signals for selective operation of the solenoids may be provided by any of various known readout devices suited to convert information, such as pattern information as recorded on tapes, cards, drums or other medium, into electrical signals. These are supplied in synchronism with operation of the machine.

A plunger connected to the solenoid may be utilized to effect the latching function and once the solenoid has been actuated the band-like member and its work element may continue to reciprocate until the solenoid is de-energized.

Additionally, the band-like member may have further latching means so that upon appropriate operation of the solenoid means, the band-like member and its accompanying work element can be positioned in a second stationary position in addition to the original rest on first stationary position. Accordingly, the work element is stationary prior to band engagement by the oscillatory shaft and may come to a second stationary position when the band is driven a predetermined distance, it being recognized that the work element can perform functions as it travels from its first to second stationary position.

BRIEF DESCRIPTION OF THE DRAWINGS

For a more detailed understanding of the invention, reference is made in the following description to the accompanying drawings in which:

FIG. 5 is a plan view showing in cross section an oscillatory member along with band actuation structure which enables a work element to be positioned in first and second stationary positions. The band and mechanism is shown in the first stationary position;

FIG. 6 is similar to FIG. 5 with the band shown in its second stationary position;

FIG. 6A is a cross sectional view taken through a portion of oscillating shaft 13 along the lines 6A—6A in FIG. 6;

DETAILED DESCRIPTION OF THE DRAWINGS

Figure 1A:
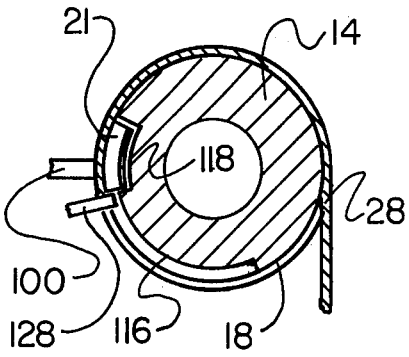
FIG. 1A is a cross sectional side view of the oscillatory shaft of FIG. 1.
Figure 1:
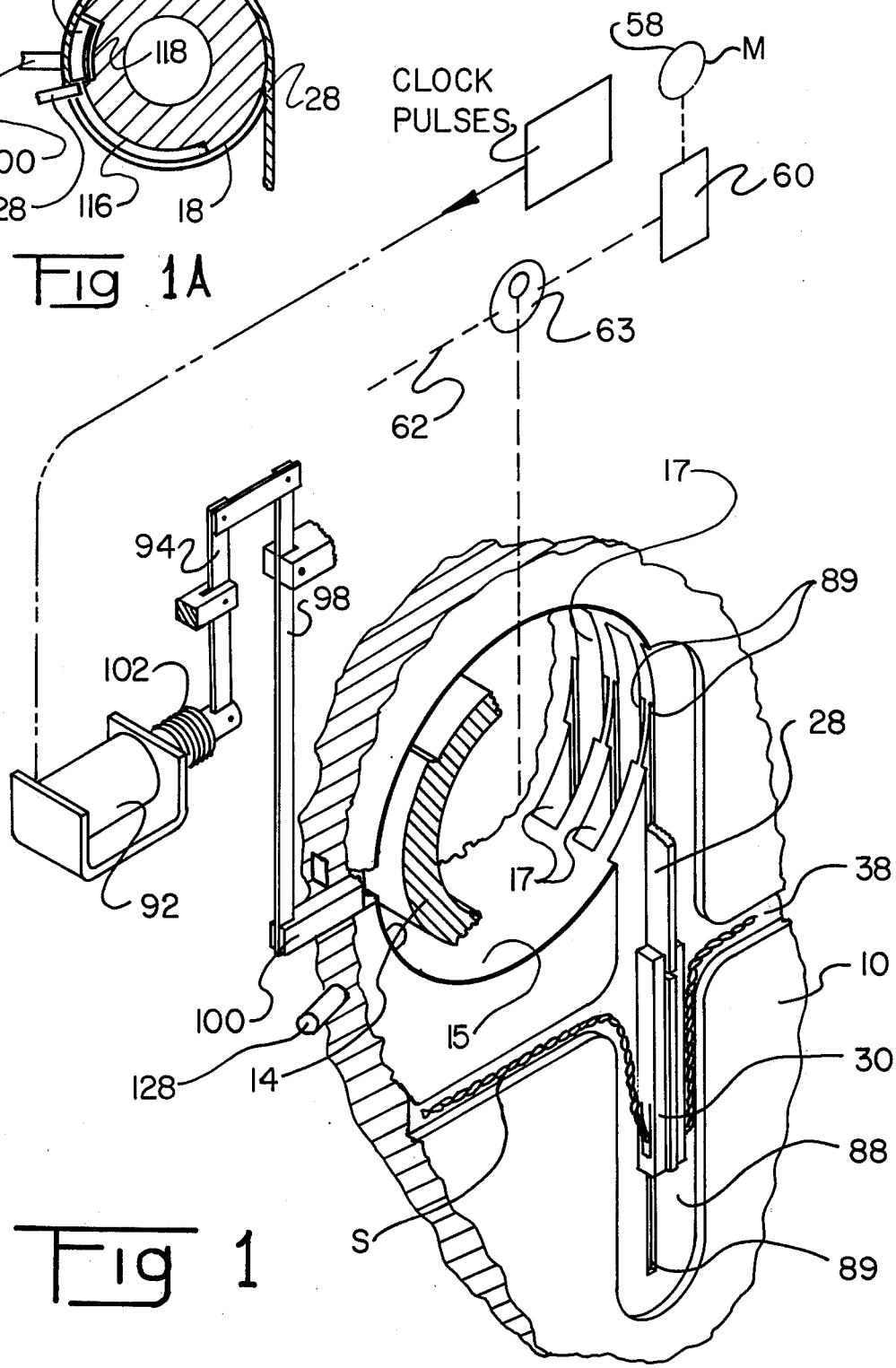
FIG. 1 is an isometric view of the subject band driving apparatus being utilized to meter and feed yarn for textile use.

With reference to FIG. 1, an isometric view of an embodiment of the subject invention is disclosed. In this particular embodiment yarn metering and feeding functions such as used in textile machinery are shown, although it is to be understood that many different operations not related to textiles may be performed. The work area and the driving apparatus are located within housing 10. A shaft 14 which is oscillatory in nature is partially shown positioned within the cavity formed by cavity wall 15. Band-like member 28 is shown extending from the area of shaft 14 to a work area below where it terminates in plunger member 30. A strand of yarn S is shown extending through yarn passageway 38 and being engaged by plunger 30.

It will be appreciated that the shaft 14 runs widthwise across the machine and many band-like members 28 are engageable by a single shaft 14. Each of the members 28 extend circumferentially around shaft 14 through openings as defined by wall structure 17. The sides of the band-like members 28 are restrained in groove-like tracks 89 which extend to cavity wall 15 to enable the band-like members 28 to be restrained as they tangentially extend from the shaft 14. It will be appreciated that the tracks 89 are on each side of wall structure 17 and accordingly, band-like member 28 is restrained on each of its sides.

The band-like member 28 is a flexible member preferably constructed of stainless steel on the order of 0.01 of an inch which is not permanently deformable. It must be flexible to adopt to the circular configuration it receives as it partially wraps around shaft 14, however, it must also be able to withstand compressive forces brought about as it is thrust downwardly once engaged by oscillatory shaft 14.

A motor 58 for driving shaft 14 is shown with transmission 60 which may be a train of gears or related mechanism affording power to power transmission means 62 schematically shown. Cam member 63 provides the hook up for shaft 14.

It will be noted that plunger 30 extends into a work area as defined by cavity 88. Within the cavity walls, the groove-like tracks 89 extend to maintain the band 28 firmly in a linear path to enable the oscillatory motion of shaft 14 to be converted to reciprocable motion as plunger 30 reciprocates as driven by band member 28.

A selection actuation means, maybe a solenoid 92, receives control signals for selective actuation of band members 28 and their respective plungers 30. For example, work elements or plungers 30 may control feeding and metering of different colored yarns which are fed to a single needle station on a tufting machine. By selectively actuating one of five or so or any number of plungers with their respective colored yarns, a selected color yarn strand may be fed and metered to a tufting machine as disclosed in co-pending application Ser. No. 699,904. Pattern information such as recorded on tape, drums or other medium is converted into electrical or other type signals as shown by clock pulses which are then transmitted to the solenoid selection actuation means 92. Intermediate structure 93 leads to actuation pin 100 which, in the off position, is biased away from shaft 14 by spring 102.

Figure 2:
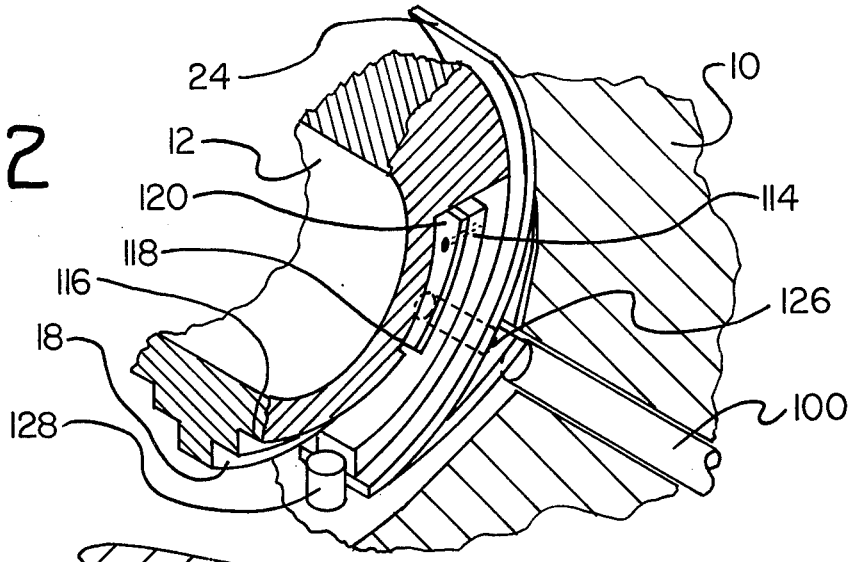
FIG. 2 is an isometric cutaway view showing the oscillatory member and band actuation structure.
Figure 3:
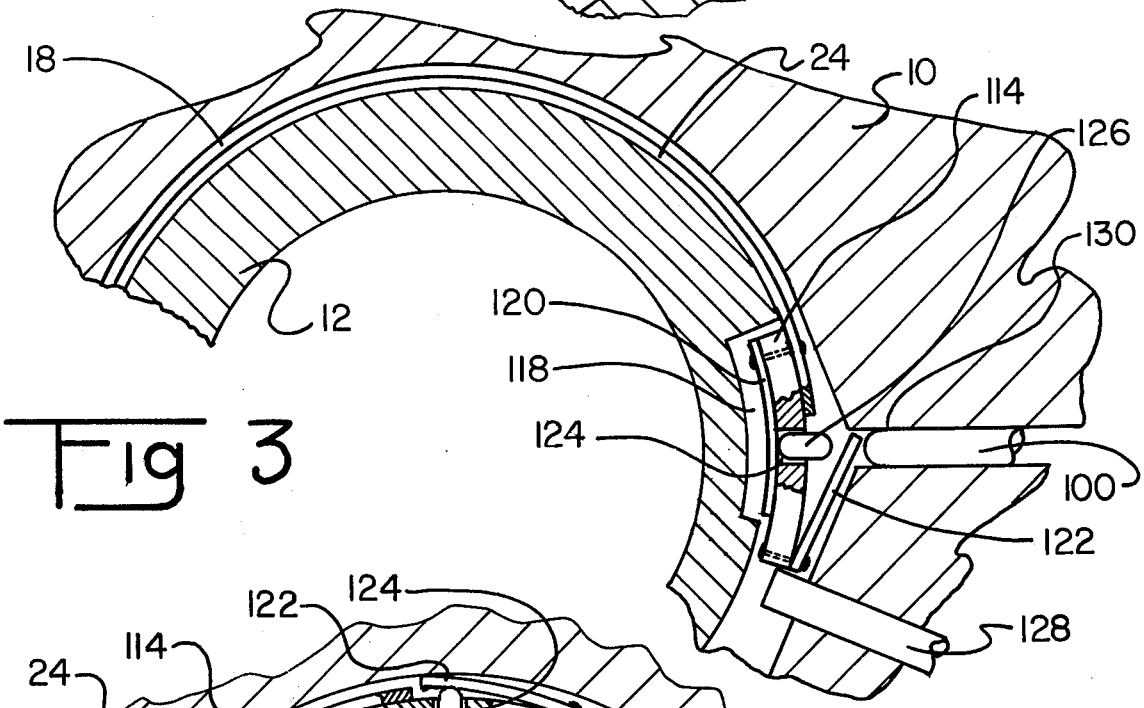
FIG. 3 is a cross sectional plan view of the mechanism of FIG. 2 with the solenoid in an off position.
Figure 4:
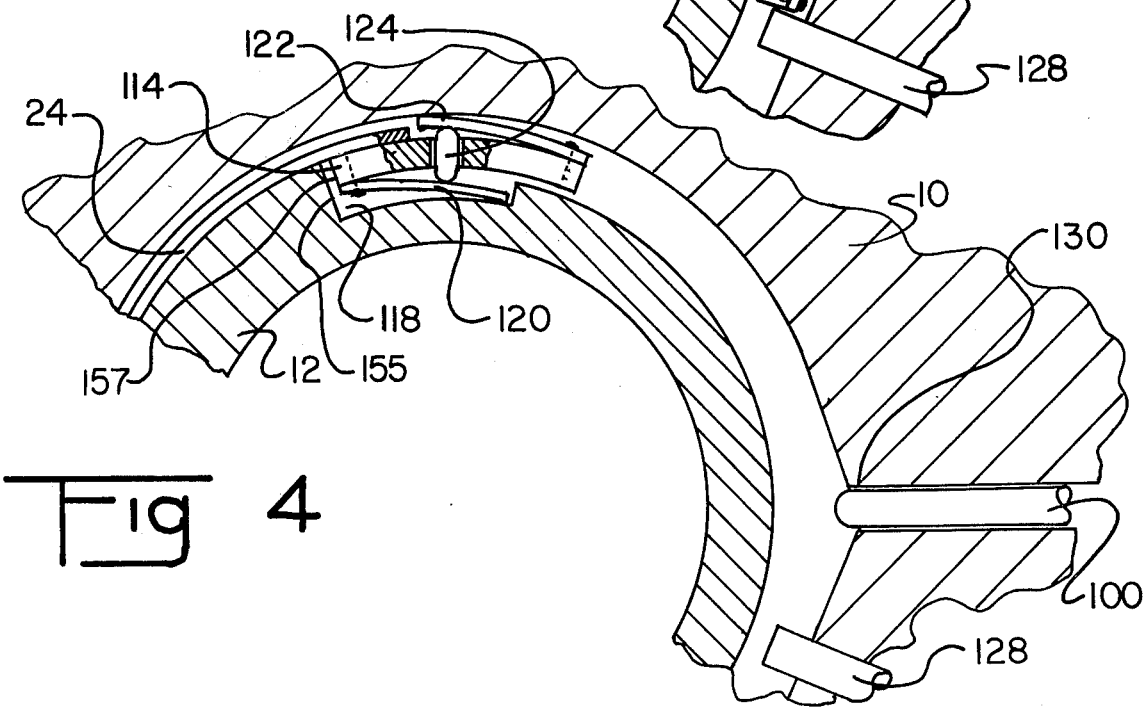
FIG. 4 is a cross sectional plan view of the mechanism of FIG. 2 with the solenoid in its on position.

With reference to FIG. 1, the oscillatory shaft 14 is shown in cross section with band-like member 28 terminating with latching mechanism schematically shown as 21 which is accommodated by groove structure of shaft 14 which will be described in detail when FIGS. 2–4 are discussed. It will be noted, however, that grooves 18, 116 and 118 of different depths are ground or otherwise formed into shaft 14.

With reference to FIGS. 2–4, of view is shown of a mechanism which causes the engagement of a band-like member 24 (which may be substantially like band-like member 28 of FIG. 1) with oscillating drive shaft or tube 12 (which may be substantially like shaft 14 of FIG. 1). The band-like member or ribbon 24 is contained in channel 18 of oscillating shaft or tube 12, and while it may slide, it has no room to bend when subjected to compression forces. The band or ribbon 24 may extend around shaft 12 for approximately 180° (see FIG. 1A) and then through a stationary channel or track-like groove such as 89 of FIG. 1 to a work element such as plunger 30 of FIG. 1. The band or ribbon 24 thus extends from the work element 30 around the shaft 12 to where it terminates in a shoe 114. As can be seen from the partial view in FIG. 2, shaft 12 closely fits within cavity 15 (FIG. 1) formed in housing 10 and groove 18 which carries band 24 is actually the shallowest of three grooves or notches in shaft 12. Shoe 114 is positioned within intermediate groove 116 which extends partially around the shaft. A third deeper notch or groove 118 has a purpose which will be described subsequently.

Figure 7:
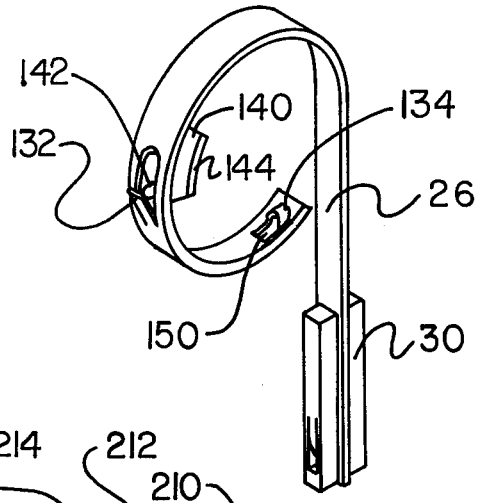
FIG. 7 is an isometric view of the band of FIG. 5.

The shoe 114 may be welded, soldered or otherwise attached to band or ribbon 24. A drive spring 120 is welded or soldered or otherwise attached to the base of shoe 114 and extends along part of the distance of shoe 114. It will be noted that the ribbon or band 24 has a portion of its center cut out to give a lanced out tab 122. This lanced out tab structure 122 is similar to the structure 132 of band 26 as shown in FIG. 7. The shoe 114 has a cavity 124 in which is contained a compressible pin 126 which bears against drive spring 120 and which extends through the lanced out portion of band or ribbon 24. A stop member 128 is rigidly secured to and embedded within housing structure 10. The left tip of actuation pin 100 is shown in its non-energized position in FIGS. 2 and 3. When plunger or actuation pin 100 is as shown in FIGS. 2 and 3, the ribbon or band-like member 24 is held out of action due to the interference of lanced tab 122 with surface 130 of housing 10. The band or ribbon 24 is prevented from being driven in a clockwise direction by stop member 128 as can be seen in FIGS. 2 and 3.

When a particular work element 30 (FIG. 1) is to be selected and hence the band or ribbon 24 of that unit is to be actuated, the plunger or actuation pin 100 is advanced thus unlatching spring 122 from surface 130. As spring 122 is unlatched, it applies pressure to the compressible pin 126 which in turn depresses the drive spring 120. As can be seen best in FIG. 3, the drive spring 120 is attached to only one end of shoe 114 and thus can be driven outwardly from the shoe by compressible pin 126 if permitted by the notch structure of shaft 12. As the shaft oscillates, it will reach the position as shown in FIG. 3 at which time the compressible pin 126 will force the lower end of drive spring 120 into engagement with notch 118. As the shaft 12 reverses, drive spring 120 will be driven in the counterclockwise direction thus driving band member 24. As the band or ribbon 24 advances, the lanced out portion or tab 122 of the ribbon or band 24 becomes trapped within groove 18 formed between the shaft 12 and the stationary housing 10 (as seen in FIG. 4), with the drive spring 120 being held in its drive position. Thus, as can be seen in FIG. 4, the band or ribbon 24 is driven as far as the oscillatory motion of the shaft 12 carries it since the drive spring 120 is engaged in the driving notch or deepest notch 118. As this counterclockwise motion of band 24 occurs, it will be appreciated that the work element will be driven downwardly within pocket or plunger channel 86 to perform a yarn feeding function. It is to be noted that while in FIG. 1 the band drives in a clockwise direction, in FIGS. 2–4, the band is shown as being driven in a counterclockwise direction.

As the shaft 12 oscillates in a clockwise direction, surfaces 155 of shaft 12 engages surface 157 of shoe 114 whereby band 24 will be returned to its unactuated position and if actuation pin 100 has been deactivated by the solenoid means, then the lanced out tab 122 will be permitted to return to its position where it abuts against surface 130, and compressible pin 126 will be permitted to release its pressure against drive spring 120 which will return to its non-driving position in juxtaposition against shoe 114 and out of engagement with notch 118. Thus, as the shaft 12 oscillates in a counterclockwise direction, the next time the band 24 will remain in its stationary non-actuated position. On the other hand, if the same work element 30 is to be used for a second time in succession, the solenoid continues to be actuated and the actuation pin or plunger 100 remains in the position as shown in FIG. 4 thus causing the band 24 to be driven by oscillating shaft 12 for a second cycle and succeeding cycles if desired.

With reference to FIGS. 5 and 6, an alternate embodiment of the selection and driving mechanism is shown. The mechanism of FIGS. 5 and 6 differs from that described in FIGS. 2–4 in the following manner. In the case of the mechanism of FIGS. 5 and 6, the band-like member drives plunger 30 (not shown — see FIG. 7) to its down position in plunger channel or pocket 88 and latches holding the plunger 30 (see FIG. 7) in this position as contrasted to the mechanism of FIGS. 2–4 wherein the work element will always be raised as the shaft oscillates and will never be left in the down position. Accordingly, the band 26 in FIGS. 5 and 6, must be selected to push plunger 30 down and deactuated to pull the plunger 30 back to its raised deactuated position.

FIG. 5 is a schematic of the mechanism as shown when the solenoid is non-actuated so that the actuation pin 100 of FIG. 1 is in its leftward position and out of engagement with the engaging mechanism. Band-like member 26 has a lanced out tab portion 132, the structure of which can be appreciated from viewing the isometric view of FIG. 7. The band 26 is shown terminating with a second lanced out portion 134 which is engageable with a latching pawl spring 136 that is connected to portion 137 of shaft 13 by welding, soldering or other means of attachment. A stop abutment 138 protrudes inwardly from housing 10 to prevent the band 26 from continuing in a counterclockwise direction further than shown in FIG. 5.

With further reference to FIG. 5, a shoe 140 is welded or otherwise secured to band 26 and has a cavity in which is positioned a compressible pin 142 similar to that described with reference to FIGS. 2 through 4. A drive spring 144 is soldered or welded or otherwise secured at one end of shoe 140 and functions in a manner similar to drive spring 120 discussed with respect to FIGS. 2–4.

With further reference to FIG. 5, the mechanism is shown in a position where plunger 30 is in a raised position. With no interference from the tip of actuation pin 100, lanced out tab 132 of band 26 has been allowed to spring out into a cavity where it abuts against surface 146 of wall 10. With tab 132 in this position, band 26 is trapped between surface 146 in the one direction and stop 138 in the other direction. As shown, pin 142 does not bear against drive spring 144 and the drive spring 144 is therefore permitted to remain in abutment throughout its length against shoe 140.

The oscillatory shaft 13 is shown having a step 148 which oscillates in a counterclockwise direction to a point below drive spring 144.

In the position of FIG. 5, the solenoid 92 is off and actuation pin 100 is to the left. When the solenoid 92 is turned on, actuation pin 100 pushes tab 132 and compressible pin 142 to apply pressure to drive spring 144. The drive spring 144 thus extends inwardly toward shaft 13 as permitted by the surface configuration of shaft 13. When the shaft 13 oscillates to its position as shown in FIG. 5, the drive spring will snap inwardly to a position which interferes with step 148 and as shaft 13 reverses to oscillate in a clockwise direction, band 26 will be driven to the opposite reversal position of shaft 13 as shown in FIG. 6. At this position, actuation pin 100 drops into a slot 150 in band 26 and pushes pawl spring 136 so that its latch cannot engage lanced tab 134 of slot 150. Slot 150 can best be seen in FIG. 7. Thus, even though shaft 13 will reverse and oscillate in a counterclockwise direction, band 26 will be held in its forward position with the plunger or work element in a down position so long as a solenoid 92 is turned on and actuation pin 100 is in the position shown in FIG. 6. When solenoid 92 is turned off, actuation pin 100 shifts to the left (from its position in FIG. 6) and thus vacates slots 150. Now when latching pawl spring 136 comes to the position shown in FIG. 6, as shaft 13 oscillates in a counterclockwise direction, the latching pawl spring 136 will engage the lanced tab 134 of slot 150 and cause the shaft 13 to drive band 26 to the position as shown in FIG. 5.

With reference to FIG. 6A, a cross section top view of a portion of shaft 13 is shown with one station (middle) and two partial stations being shown. Each of the stations are separated by the outermost portions 151 (as measured from the center longitudinal axis) of the shaft 13. Immediately adjoining these separator portions 151 are shoulders 153 which have been grooved out to support band-like members 26.

Figure 8:
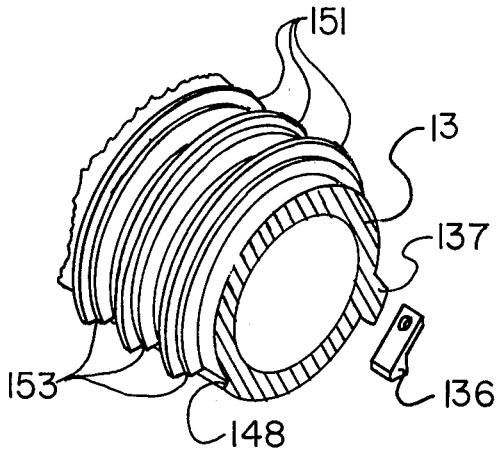
FIG. 8 is an isometric view of an oscillatory shaft as used in FIG. 5.

With reference to FIG. 8, the shaft 13 of FIGS. 5 and 6 is shown together with ratchet-pawl spring 136 which will of course be connected to portion 137. As can be seen, shaft 13 is provided with a series of ribbon or band receiving areas extending lengthwise as separated by shaft portions 151. Any number of different bands may be engageable by the same shaft and as seen in FIG. 6A, they will be supported by ledges or shoulders 153.

Figure 9:
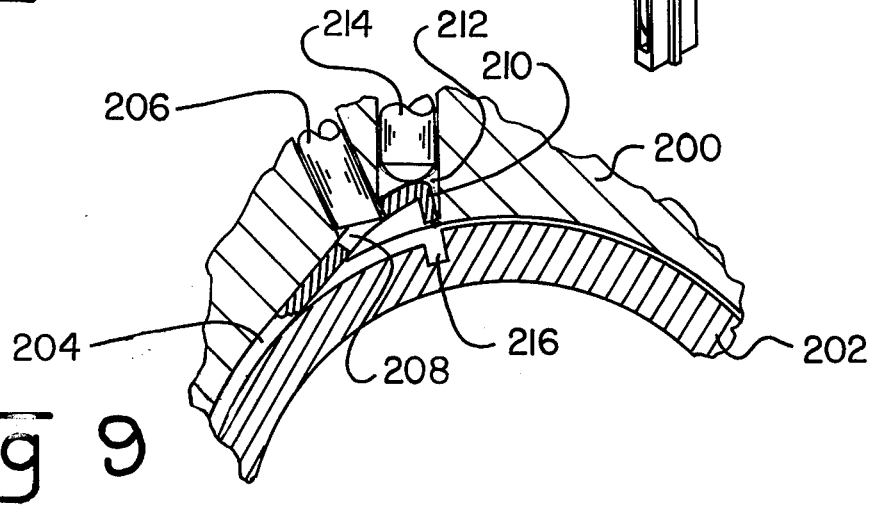
FIG. 9 is an alternate embodiment of the actuation and latching means for a band.

FIG. 9 discloses an alternate embodiment to the band engaging and latching mechanism of the preceding figures. A housing 200 is shown with shaft 202 positioned within a mating recess area. It is to be understood that the housing extends around the shaft as well as into the work object area where a groove or track on the order of track 89 of FIG. 1 is present to confine the band-like member or ribbon 204 extending from the shaft 202. Band or ribbon member 204 is positioned so that in its deactuation position it is secured by element 206 which is shown engaging band 204 within band slot 208. It is to be understood that the band 204 extends approximately 180° around the shaft 202 and into a stationary linear track such as previously discussed.

Band 204 terminates in a hooked portion 210 which is shown abutting against surface wall 212 of housing 200 which serves as a stop for clockwise movement of the band. An actuation pin 214 of a solenoid (not shown) serves to engage hook portion 210 of band 204 when the solenoid is energized or deenergized depending upon the design of the apparatus. Shaft 202 is shown having a recess 216 which, during its operating cycle will oscillate to the position shown. Upon energizing of the solenoid, actuation pin 214 will drive hooked portion 210 of band 204 against the shaft surface and when the slot 216 is directly below the hook end 210, the band 204 will be engaged and since the band slot 208 will clear element 206, the band will be driven counterclockwise upon counterclockwise rotation of the shaft. The band 204 will continue to be driven by oscillating shaft 202 so long as the actuation pin 214 is down in its energized position.

Upon the de-energization of the solenoid, actuation pin 214 will raise and on the next cycle as shaft 202 rotates in a clockwise directon, the hooked portion 120 of band 204 will raise as permitted by actuation pin 214 with the tip abutting surface wall 212 and the band slot 208 engaging element 206. On the next revolution, the shaft will oscillate without band member 204 which will be the condition until the solenoid is energized once again.

Figure 10:
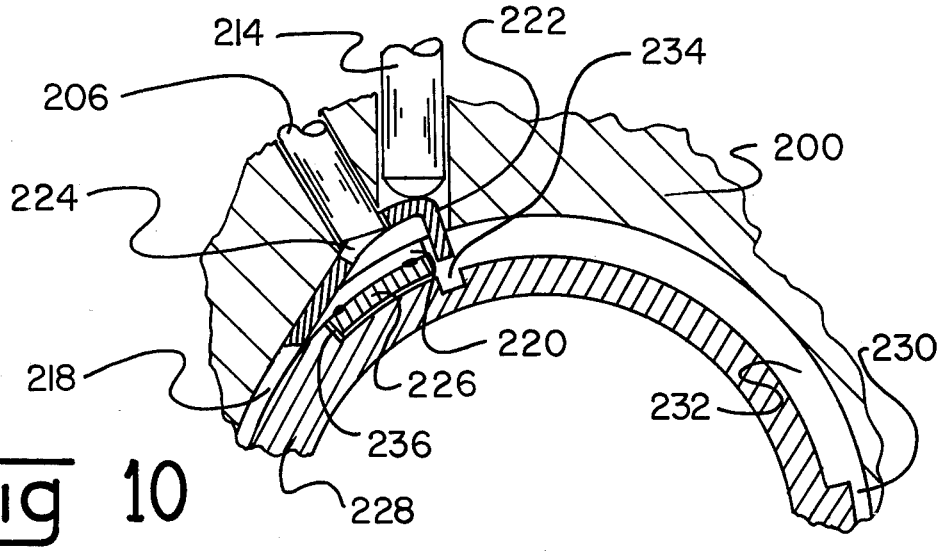
FIG. 10 shows a further modification of band actuation and latching means.

With reference to FIG. 10, another alternate embodiment of the latching and engaging mechanism is shown. The housing 200, actuation pin 214 and latching element 206 are shown to be essentially the same as those elements described in FIG. 9. The band 218 is split and has bifurcated ends 220. The center portion of the band has a hooked terminus 222 similar to that disclosed in FIG. 9. A slot 224 is formed to receive the latching element 206. A shoe 226 is welded or soldered or otherwise secured to the side portion 220 of band 218. Shaft 228 is either spaced from housing 200 to provide a notch or groove 230 to be used to receive band 218 in those areas where the band extends or the shaft 228 is notched to provide the band space 230. A deeper notch 232 extends part way around the periphery of the shaft and a latching notch 234 is also part of the shaft 228 structure.

Upon actuation of pin 214, the hooked portion 222 of band 218 will be driven downward and when the shaft 228 rotates to the position of FIG. 10, hooked portion 222 will be engaged in notch or slot 234 of shaft 228. The hooked portion 222 will be pushed down clear of latching element 206 and as shaft 228 rotates counterclockwise, the band 218 will be driven or pulled as the tip of portion 222 is engaged within slot 234. As the shaft oscillates in a clockwise direction, surface 236 drives shoe 226 and the band 218 will be returned. As long as actuation pin 214 is depressed, the band 218 will continue to oscillate with the shaft. Upon release of actuation pin 214, the hooking pin 222 will be disengaged and the shaft 228 will oscillate without band 218 being engaged.

It should be noted that with respect to the construction of the band-like member and the oscillating shaft, the smaller the shaft is, the thinner the band must be. Since the band should not take permanent deformation, Hook's Law of Stress should not be surpassed. While hardened stainless steel is preferred for the band-like member, plastic bands and other metal bands can be as well, so long as they do not take permanent deformation. As an example, it has been found that stainless steel bands on the order of 1/100 of an inch in thickness are acceptable for the operations discussed herein using a 5 inch drive shaft.

The present invention may be embodied in other specific forms without departing from the spirit or essential attributes thereof, and, accordingly, reference should be made to the appended claims, rather than to the foregoing specification as indicating the scope of the invention.

What is claimed is:

1. A means of converting oscillating motion to reciprocating motion, comprising:

an oscillatory member;

structure adjacent to said oscillatory member forming a peripheral track around at least a portion of said oscillatory member;

structure forming a track extending from said oscillatory member;

a band-like member selectively engageable with said oscillatory member and extendable within said extending track from said oscillatory member, said extending track preventing unwanted flexing of said band-like member within said extending track, a work end of said band-like member being away from said oscillatory member and reciprocable when said band-like member is engaged by said oscillatory member; and, means for causing said band-like member to become engaged with said oscillatory member.

2. The apparatus of claim 1 including a plurality of band-like members and further comprising a means of selectively engaging at least one of said band-like members with said oscillating member.

3. The apparatus of claim 1 wherein one of said oscillatory or band-like members has a notch and the other has a protrusion, said apparatus further comprising means of driving said protrusion into said notch to cause said band-like member to be engaged by said oscillatory member.

4. The apparatus of claim 1 wherein a portion of said structure adjacent said oscillatory member has an abutment, and wherein said band-like member includes a portion engageable with said abutment to prevent movement of said band-like member unless actuated.

5. The apparatus of claim 4 further including plunger means for driving said engageable portion of said band-like member free from said abutment and for driving said band-like member into engagement with said oscillatory member.

6. The apparatus of claim 1 further including a means to retain said band-like member in an extended reciprocated position while said oscillatory member continues to oscillate.

7. The apparatus of claim 6 wherein said means to retain said band-like member in its extended reciprocated position includes a slot in said band-like member engageable with external structure.

8. The apparatus of claim 7 further including means to release said band-like member as retained in its extended reciprocated position.

9. The apparatus of claim 8 wherein said means to release comprises a pawl spring element secured to a portion of said shaft and engageable with said slot.

10. The apparatus of claim 1 wherein said band-like member terminates in a hooked portion and wherein said oscillating member has a slot for receiving said hooked portion.

11. The apparatus of claim 10 further including a means to drive said hooked portion of said band-like member into engagement with said slot of said oscillatory member.

12. The apparatus of claim 10 further including a stationary latching element and wherein said band-like member includes a slot for receiving said latching element when said band-like member is in a non-engaged position.

13. The apparatus of claim 1 wherein said means for causing engagement comprises a solenoid and a solenoid plunger element.

14. Driving apparatus including a selection device wherein one of a plurality of band selection members are selected comprising an oscillatory member; walls adjacent to said oscillatory member forming a peripheral track around at least a portion of said oscillatory member; structure forming a confining track extending from said oscillatory member; and means of selecting one of said plurality of selection band members, each of said plurality of band selection members being engageable with said oscillatory member upon selection and extendable within said confining track from said oscillatory member, each of said band selection members having an end removed from said oscillatory member which is reciprocable when said band selection member is engaged by said oscillatory member.

15. Driving apparatus comprising:

an oscillatory member having circumferential grooves;

structure adjacent said oscillatory member wherein a first groove forms a track around at least a portion of said oscillatory member;

a band member slidable within said first groove and having protruding structure positioned within a second groove, said band member further having an element extendable from said protruding structure and engageable within a third groove;

a pin extendable through said protruding structure to be engageable with said element, said band member having an actuating portion engageable with said pin; and actuation means positioned to drive said actuating portion against said pin thereby causing said element to be engaged in said third groove.

16. The apparatus of claim 15 wherein said actuating portion includes a cavity into which said pin extends.

17. Driving apparatus for converting oscillating motion to reciprocating motion comprising:

an oscillatory member;

a track around a portion of said oscillatory member and extending away from said oscillatory member;

a band-like member selectively engageable by a portion of said oscillatory member and extendable within said track, said band-like member having an end removed from said oscillatory member and reciprocable as said band-like member is engaged by said oscillatory member; and means to cause said band-like member to become engaged with said oscillatory member.

* * * * *

UNITED STATES PATENT OFFICE

CERTIFICATE OF CORRECTION

Patent No. 4,059,021 Dated November 22, 1977

Inventor(s) Abram N. Spanel, Frank Eiland and David R. Jacobs

It is certified that error appears in the above-identified patent and that said Letters Patent are hereby corrected as shown below:

Column 2, line 6, delete "necessary" and insert --necessarily--.

Column 4, line 12, delete "of" and insert --a--.

Column 5, line 20, delete "surfaces"and insert --surface--.

Column 5, line 58, after "can" insert --best--.

Column 6, line 43, delete "slots" and insert --slot--.

Column 7, line 19, delete "energizing" and insert --energization--.

Column 7, line 47, delete "portion" and insert --portions--.

Column 8, line 43, delete "oscillating" and insert --oscillatory--.

Signed and Sealed this

*Fourteenth* Day of *March 1978*

[SEAL]

*Attest:*

RUTH C. MASON
*Attesting Officer*

LUTRELLE F. PARKER
*Acting Commissioner of Patents and Trademarks*